US009383678B2

(12) United States Patent
Furutani et al.

(10) Patent No.: US 9,383,678 B2
(45) Date of Patent: Jul. 5, 2016

(54) DEVELOPER ACCOMMODATING CONTAINER, PROCESS CARTRIDGE AND IMAGE FORMING APPARATUS

(71) Applicant: CANON KABUSHIKI KAISHA, Tokyo (JP)

(72) Inventors: Masaki Furutani, Tokyo (JP); Kojiro Yasui, Numazu (JP); Hiroomi Matsuzaki, Mishima (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,575

(22) Filed: Sep. 6, 2013

(65) Prior Publication Data

US 2014/0072346 A1 Mar. 13, 2014

(30) Foreign Application Priority Data

Sep. 11, 2012 (JP) ..... 2012-199454

(51) Int. Cl.
*G03G 15/08* (2006.01)

(52) U.S. Cl.
CPC ..... *G03G 15/0865* (2013.01); *G03G 15/0874* (2013.01); *G03G 15/0875* (2013.01); *G03G 15/0894* (2013.01); *G03G 2215/0682* (2013.01)

(58) Field of Classification Search
CPC ..... G03G 15/0874; G03G 15/0875; G03G 2215/068; G03G 2215/066; G03G 2215/0682
USPC ..... 399/120, 262, 109
See application file for complete search history.

(56) References Cited

U.S. PATENT DOCUMENTS

| | | | | | |
|---|---|---|---|---|---|
| 4,522,487 | A | * | 6/1985 | Misawa | G03G 21/12 399/102 |
| 5,943,529 | A | | 8/1999 | Miyabe et al. | |
| 5,966,567 | A | | 10/1999 | Matsuzaki et al. | |
| 5,987,286 | A | * | 11/1999 | Shin et al. | 399/258 |
| 6,011,941 | A | | 1/2000 | Takashima et al. | |
| 6,097,906 | A | | 8/2000 | Matsuzaki et al. | |

(Continued)

FOREIGN PATENT DOCUMENTS

| | | | | |
|---|---|---|---|---|
| JP | 4-66980 | A | 3/1992 | |
| JP | 2008-233332 | * | 10/2008 | G03G 15/08 |

OTHER PUBLICATIONS

Office Action in Chinese Patent Application No. 201310402956.X, dated Nov. 4, 2015.

*Primary Examiner* — Sophia S Chen
(74) *Attorney, Agent, or Firm* — Fitzpatrick, Cella, Harper & Scinto

(57) ABSTRACT

A developer accommodating container for accommodating a developer for image formation, includes a first flexible member having a three-dimensional shape; a second flexible member for forming a space for accommodating the developer by covering a part of the first flexible member; wherein the developer accommodating container is constituted by bonding the first flexible member and the second flexible member to each other, and an injection opening, provided between the first flexible member and the second flexible member, for permitting injection of the developer into the developer accommodating container. An adjacent side, which is one of sides constituting an outer configuration of the three-dimensional shape and which is adjacent to the injection opening, has an angle of less than 90 degrees with respect to an injection direction of the developer at the injection opening.

13 Claims, 13 Drawing Sheets

(56) References Cited

U.S. PATENT DOCUMENTS

| | | | |
|---|---|---|---|
| 6,144,815 | A | 11/2000 | Chadani et al. |
| 6,173,140 | B1 | 1/2001 | Suzuki et al. |
| 6,173,145 | B1 | 1/2001 | Chadani et al. |
| 6,205,305 | B1 | 3/2001 | Suzuki et al. |
| 6,219,504 | B1 | 4/2001 | Matsuzaki et al. |
| 6,282,389 | B1 | 8/2001 | Matsuzaki et al. |
| 6,405,004 | B2 | 6/2002 | Matsuzaki et al. |
| 6,549,736 | B2 | 4/2003 | Miyabe et al. |
| 6,681,088 | B2 | 1/2004 | Kanno et al. |
| 6,782,219 | B2 | 8/2004 | Yoshino et al. |
| 6,792,229 | B2 | 9/2004 | Matsuzaki |
| 6,795,666 | B2 | 9/2004 | Miyabe et al. |
| 6,834,173 | B2 | 12/2004 | Yamaguchi et al. |
| 6,859,629 | B2 | 2/2005 | Miura et al. |
| 6,915,092 | B2 | 7/2005 | Yamaguchi et al. |
| 6,931,226 | B2 | 8/2005 | Chadani et al. |
| 6,934,485 | B2 | 8/2005 | Miyabe et al. |
| 6,947,687 | B2 | 9/2005 | Yamaguchi et al. |
| 6,961,528 | B2 | 11/2005 | Yamaguchi et al. |
| 6,978,100 | B2 | 12/2005 | Yasui et al. |
| 6,983,115 | B2 | 1/2006 | Isobe et al. |
| 7,016,626 | B2 | 3/2006 | Yokomori et al. |
| 7,068,965 | B2 | 6/2006 | Yoshino et al. |
| 7,085,516 | B2 | 8/2006 | Kawai et al. |
| 7,116,925 | B2 | 10/2006 | Yamaguchi |
| 7,136,604 | B2 | 11/2006 | Chadani et al. |
| 7,155,137 | B2 | 12/2006 | Yasui et al. |
| 7,184,687 | B2 | 2/2007 | Yamaguchi |
| 7,194,225 | B2 | 3/2007 | Yamaguchi |
| 7,224,925 | B2 | 5/2007 | Sato et al. |
| 7,319,834 | B2 | 1/2008 | Yamaguchi |
| 7,349,657 | B2 | 3/2008 | Sato et al. |
| 7,412,193 | B2 | 8/2008 | Sato et al. |
| 7,477,865 | B2 | 1/2009 | Yamaguchi |
| 7,519,310 | B2 | 4/2009 | Yamaguchi et al. |
| 7,792,460 | B2 | 9/2010 | Yamaguchi et al. |
| 8,121,519 | B2 | 2/2012 | Yamaguchi et al. |
| 8,577,252 | B2 | 11/2013 | Anan et al. |
| 2012/0027457 | A1 | 2/2012 | Yamaguchi et al. |
| 2013/0136489 | A1 | 5/2013 | Yamaguchi et al. |
| 2013/0164039 | A1 | 6/2013 | Matsushita et al. |
| 2013/0336679 | A1 | 12/2013 | Furutani et al. |
| 2013/0343785 | A1 | 12/2013 | Matsuzaki et al. |
| 2014/0016961 | A1 | 1/2014 | Yasui et al. |
| 2014/0029974 | A1 | 1/2014 | Uesugi et al. |
| 2014/0064793 | A1 | 3/2014 | Matsuzaki et al. |
| 2014/0072329 | A1 | 3/2014 | Uesugi et al. |
| 2014/0072330 | A1 | 3/2014 | Yoshida et al. |
| 2014/0072331 | A1 | 3/2014 | Matsushita et al. |
| 2014/0072347 | A1 | 3/2014 | Furutani et al. |
| 2014/0079432 | A1 | 3/2014 | Matsuzaki et al. |

* cited by examiner

DEVELOPER ACCOMMODATING CONTAINER, PROCESS CARTRIDGE AND IMAGE FORMING APPARATUS

FIELD OF THE INVENTION AND RELATED ART

The present invention relates to an image forming apparatus, and a developer accommodating container to be used in the image forming apparatus, and a process cartridge.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine and the like. The cartridge is prepared by integrally constituting at least a developing means and a developing device accommodating a developer and is made detachably mountable to an image forming apparatus main assembly, or the cartridge is prepared by integrally constituting the developing device and a photosensitive member unit including at least a photosensitive member and is made detachably mountable to the image forming apparatus main assembly.

Further, a developer accommodating container is accommodated in the image forming apparatus or the cartridge, and includes a flexible container for accommodating the developer.

In a conventional electrophotographic image forming apparatus, a process cartridge type in which an electrophotographic photosensitive member and a process means actable on the photosensitive member are integrally assembled into a cartridge and the cartridge is made detachably mountable to an electrophotographic image forming apparatus main assembly has been employed.

In such a process cartridge, as shown in FIG. 14, a developer is filled from an opening (portion) provided to a developer accommodating frame 31 for accommodating the developer and then is sealed with a toner seal 32 as a sealing member. Further, during use, a bonding portion 33 of the toner seal 32 is peeled off to unseal the opening to permit supply or the developer. Such a type has been widely employed (Japanese Laid-Open Patent Application (JP-A) Hei 4-66980).

As in JP-A Hei 4-66980, in a constitution in which the deformable inside container and an elastic member are used, filling of the developer from the opening for permitting discharge of the developer involves many problems in manufacturing, and further it takes much cost in some cases.

SUMMARY Of THE INVENTION

A principal object of the present invention is to provide a developer accommodating container and the like capable of easily filling a developer from an opening and having a high reliability of a filling step during filling of the developer.

According to an aspect of the present invention, there is provided a developer accommodating container for accommodating a developer for image formation, comprising: a first flexible member having a three-dimensional shape; a second flexible member for forming a space for accommodating the developer by covering a part of the first flexible member; wherein the developer accommodating container is constituted by bonding the first flexible member and the second flexible member to each other, and an injection opening, provided between the first flexible member and the second flexible member, for permitting injection of the developer into the developer accommodating container, wherein an adjacent side, which is of sides constituting an outer configuration of the three-dimensional shape and which is adjacent to the injection opening, has an angle of less than 90 degrees with respect, to an injection direction of the developer at the injection opening.

These and other objects, features and advantages of the present invention will become more apparent upon a consideration of the following description of the preferred embodiments of the present invention taken in conjunction with the accompanying drawings.

Figure 5:
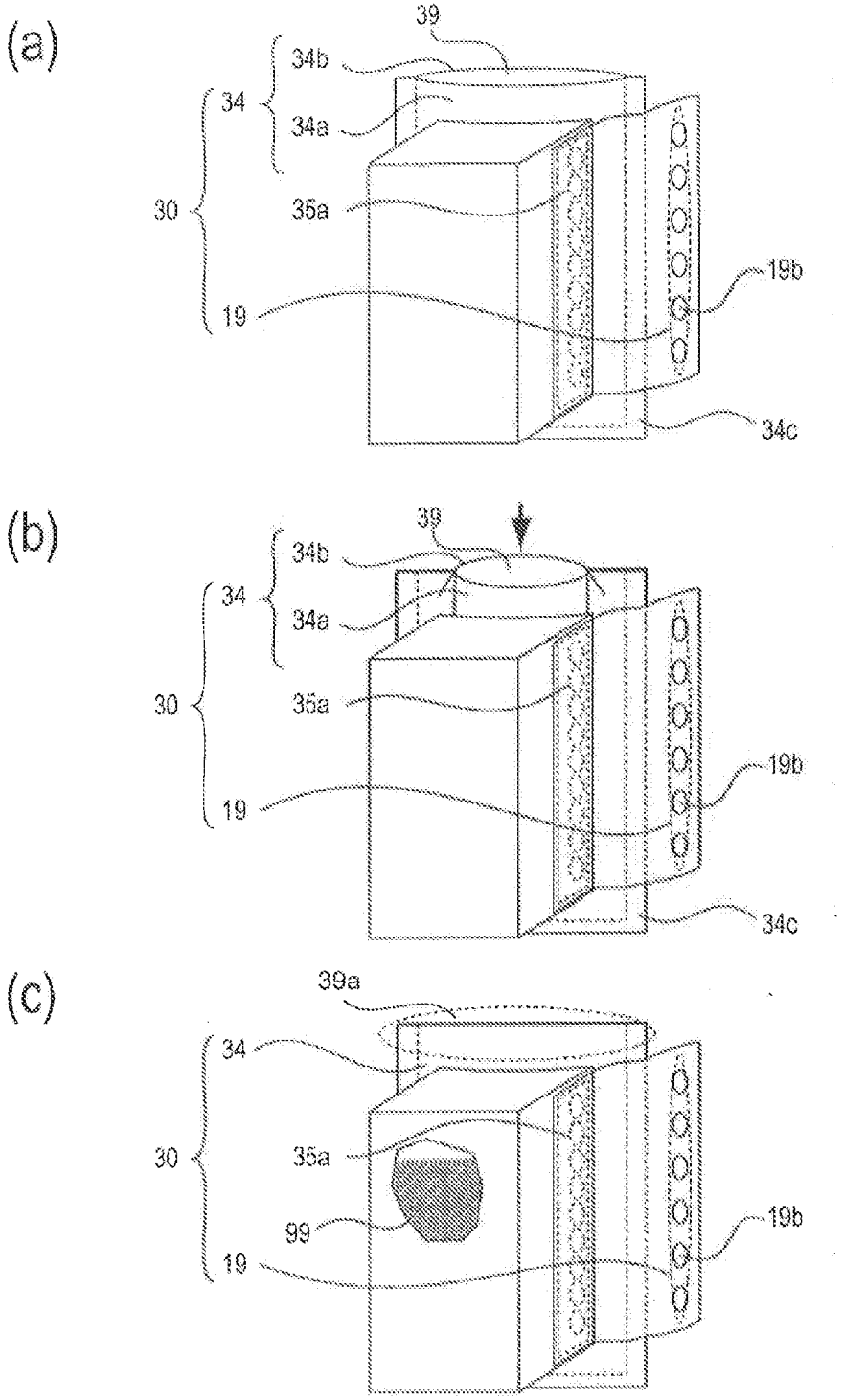

Parts (a), (b) and (c) of FIG. 5 are perspective views for illustrating states of the developer accommodating container before and after injection (filling) of a developer into the developer accommodating container, wherein (a) shows a state before an injection opening is opened, (b) shows a state in which the injection opening is opened, and (c) shows a state after the developer is injected (filled).

Figure 6:
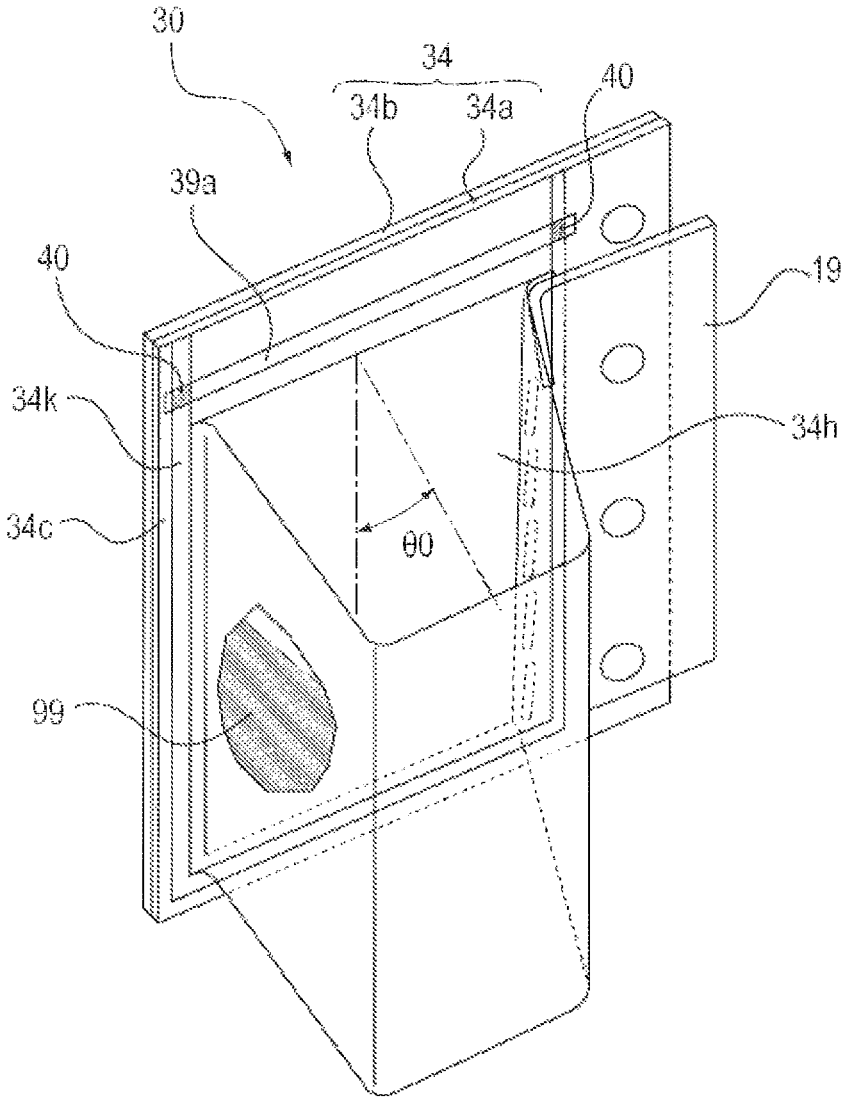

FIG. 6 is a perspective view of a developer accommodating member for illustrating unsealing of the injection opening.

Figure 7:
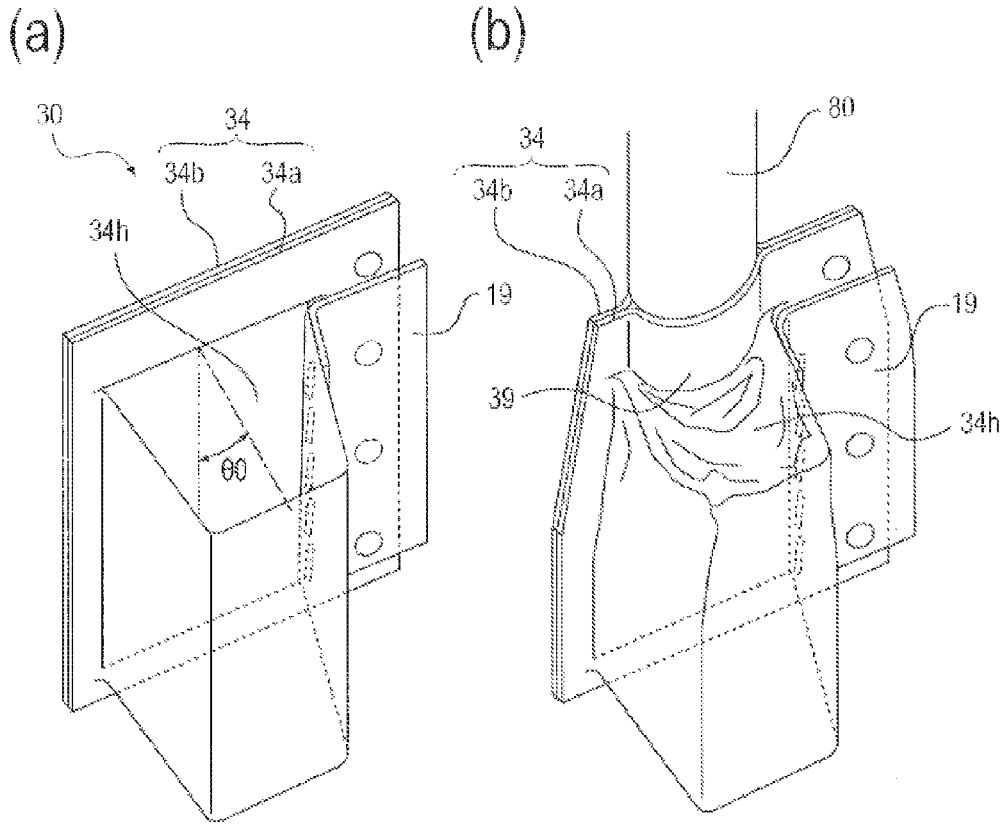

Parts (a) and (b) of FIG. 7 are perspective views showing the developer accommodating member in the case where an adjacent side has an angle of 90 degrees with respect to an injection direction of the developer, wherein (a) shows the developer accommodating member before the unsealing, and (b) shows the developer accommodating member in a state in which a filling nozzle is inserted into the injection opening during the filling.

Figure 8:
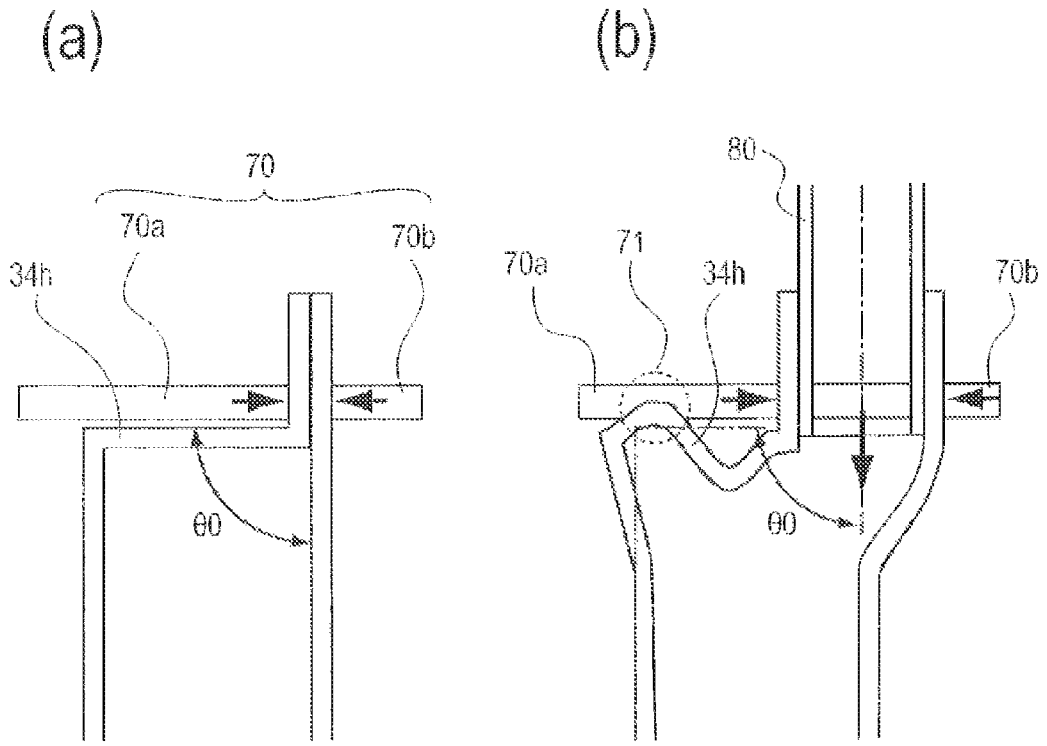

Parts (a) and (b) of FIG. 8 are sectional views each showing a cross section of the developer accommodating member shown in FIG. 7, wherein (a) and (b) are the sectional views of the developer accommodating member 34 along a line passing through the center of the developer accommodating member 34 shown in (a) and (b) of FIG. 7, respectively.

Figure 9:
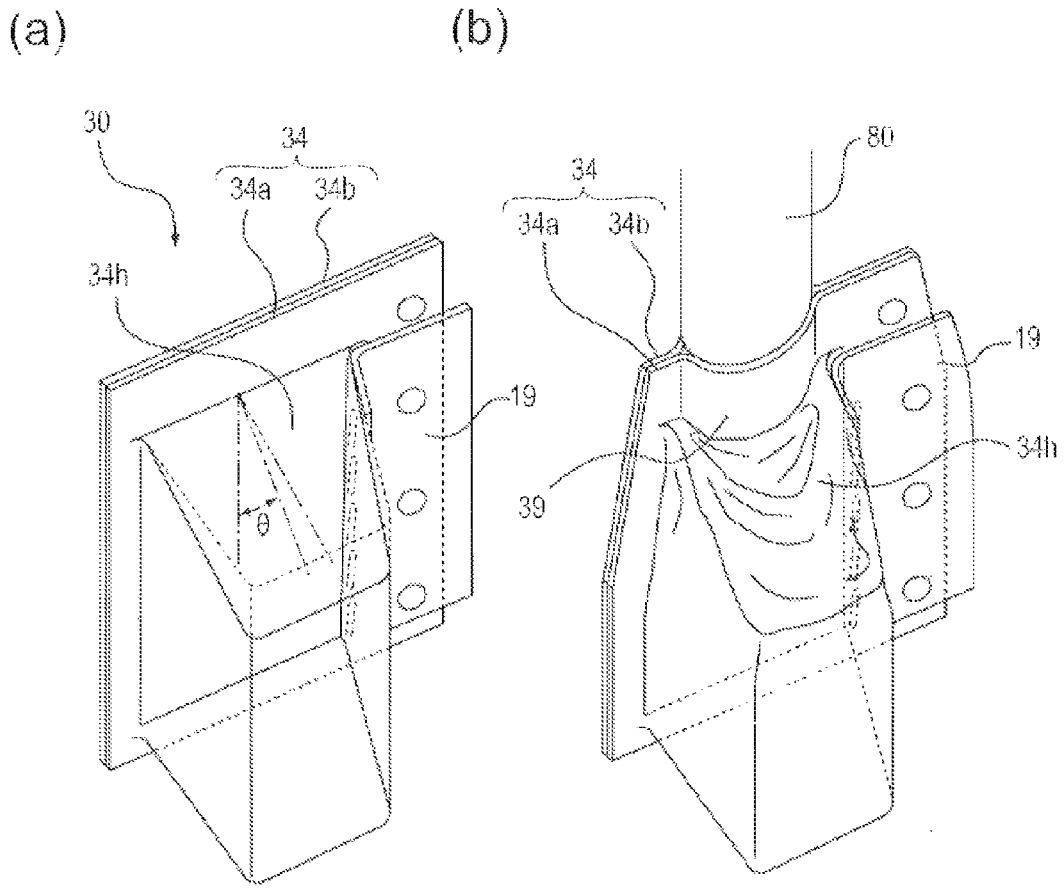

Parts (a) and (b) of FIG. 9 are perspective views showing the developer accommodating member in the case where an adjacent side has an angle of less than 90 degrees wish respect to an injection direction of the developer in Embodiment 1, wherein (a) shows the developer accommodating member before the unsealing, and (b) shows the developer accommodating member in a state in which a filling nozzle is inserted into the injection opening during the filling.

Figure 10:
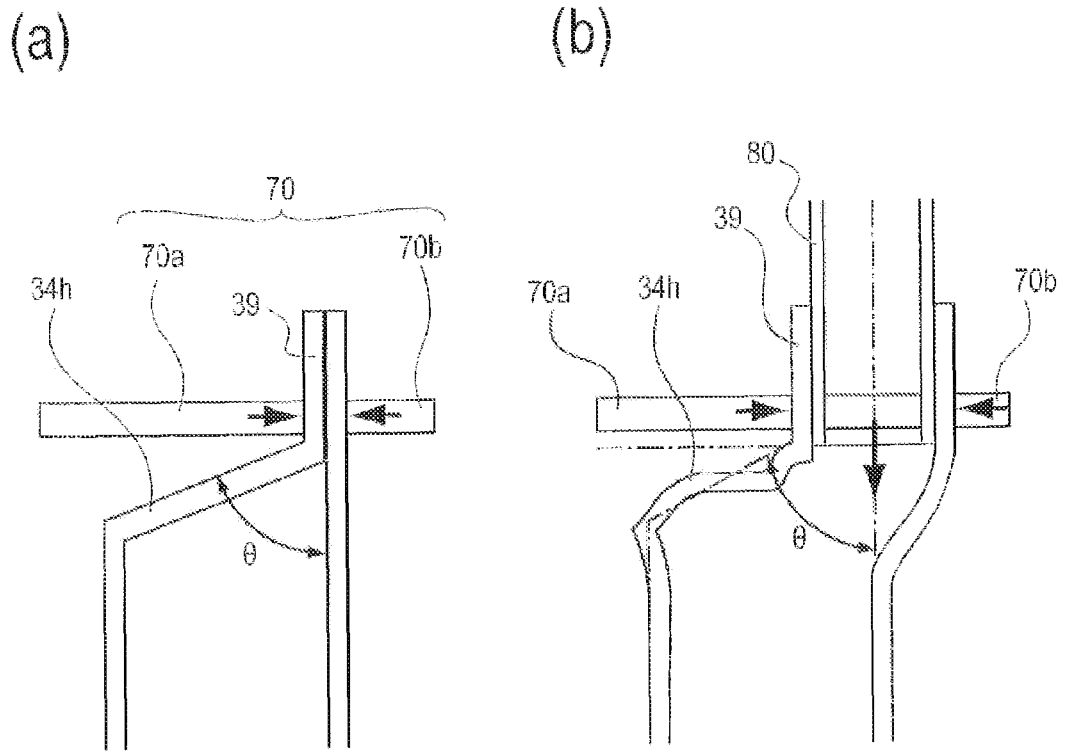

Parts (a) and (b) of FIG. 10 are sectional views each showing a cross section of the developer accommodating member shown in FIG. 7, wherein, (a) and (b) are the sectional views of the developer accommodating member 34 along a line passing through the center of the developer accommodating member 34 shown in (a) and (b) of FIG. 9, respectively.

Figure 11:
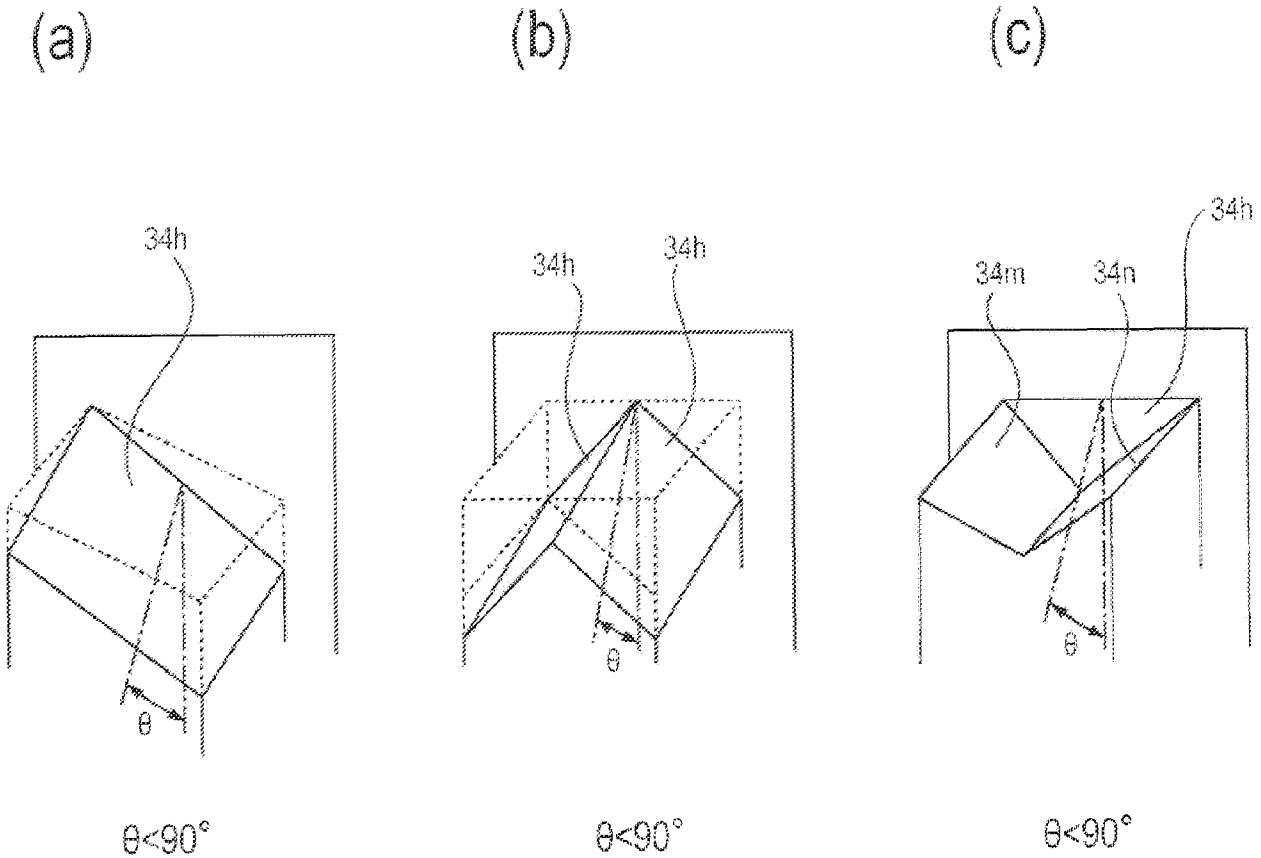

Parts (a), (b) and (c) of FIG. 11 are perspective views each showing arrangement of an adjacent side in Embodiment 2, wherein (a) shows an example in which the adjacent side has an angle of less than 90 degrees with respect to an injection direction of an injection opening and is inclined also with respect to an outer peripheral portion of an accommodating portion, (b) shows an example in which an adjacent side is formed by a plurality of sides each having the angle of less than 90 degrees with respect to the injection opening, and (c) shows an example in which a plurality of sides other than a side in accordance with a definition of the adjacent side are provided.

Figure 12:
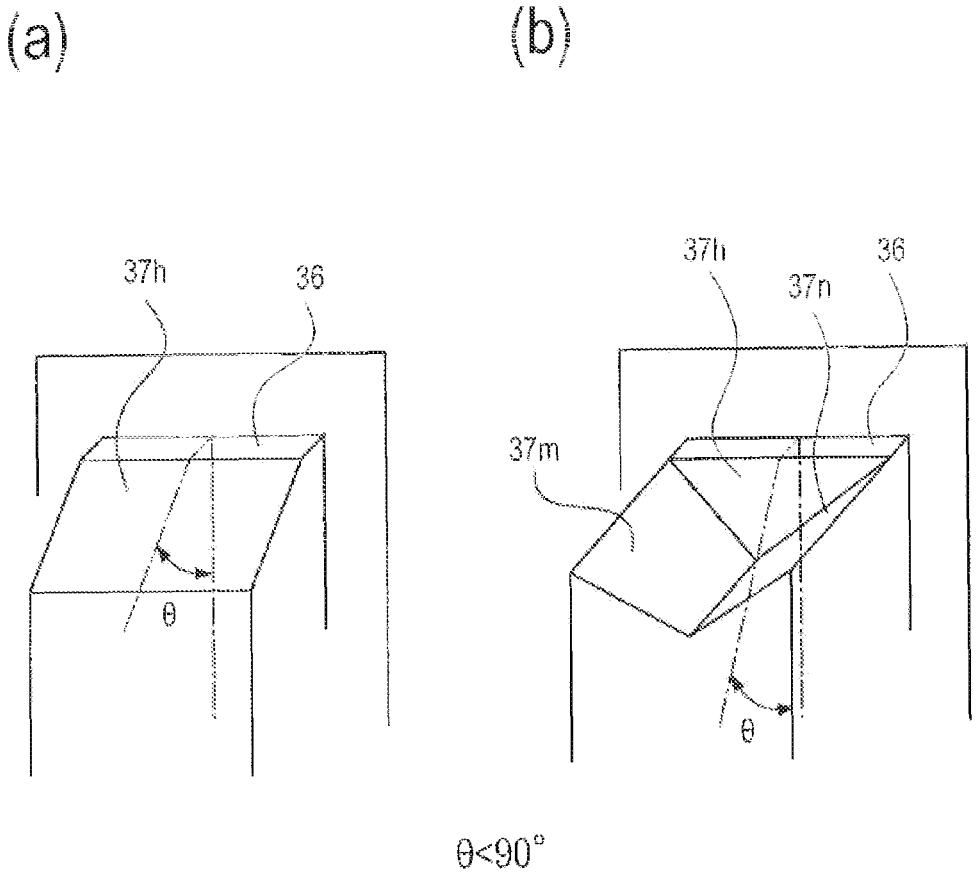

Parts (a) and (b) of FIG. 12 are perspective views each showing arrangement of an adjacent side and a close side in Embodiment 3 such that the adjacent side does not have the angle of less than 90 degrees with respect to a developer injection direction but the close side has the angle of less than 90 degrees with respect to the developer injection direction, wherein (a) shows an example in which the close side has an angle of less than 90 degrees with respect to an injection direction of an injection opening and is inclined also with respect to an outer peripheral portion of an accommodating portion, and (b) shows an example in which the close side is formed by a plurality of sides each having the angle of less than 90 degrees with respect to the injection opening.

Figure 13:
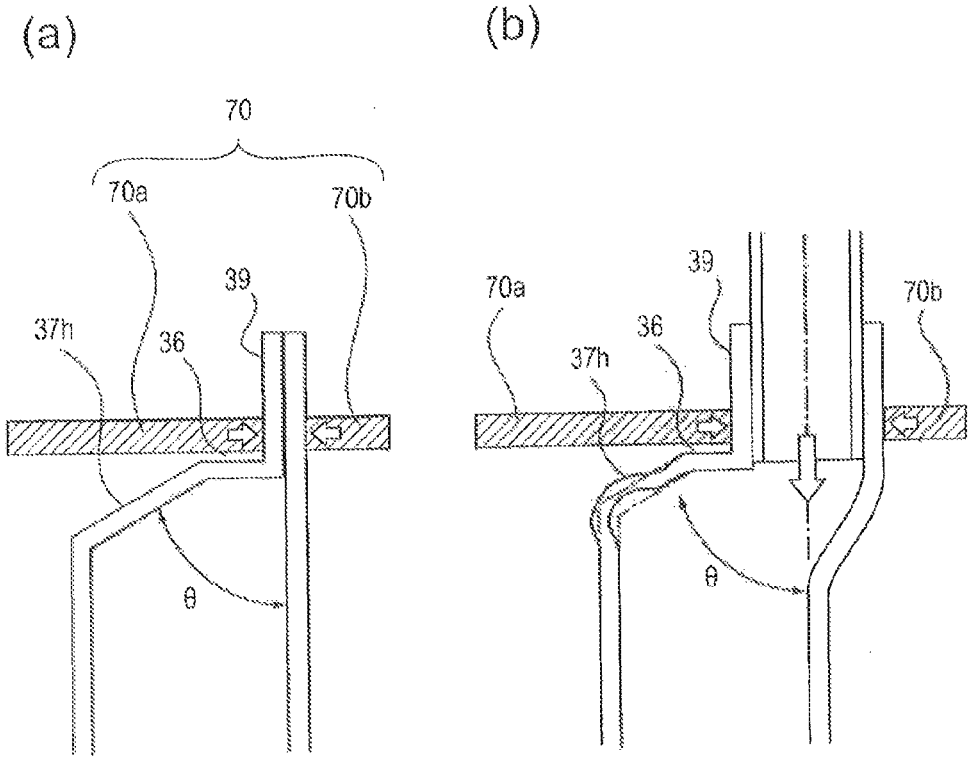

Parts (a) and (b) of FIG. 13 are sectional views showing the developer accommodating member shown in (a) of FIG. 12, wherein (a) shows the developer accommodating member before the unsealing, and (b) shows the developer accommodating member in a state in which a filling nozzle is inserted into the injection opening during the filling.

Figure 14:
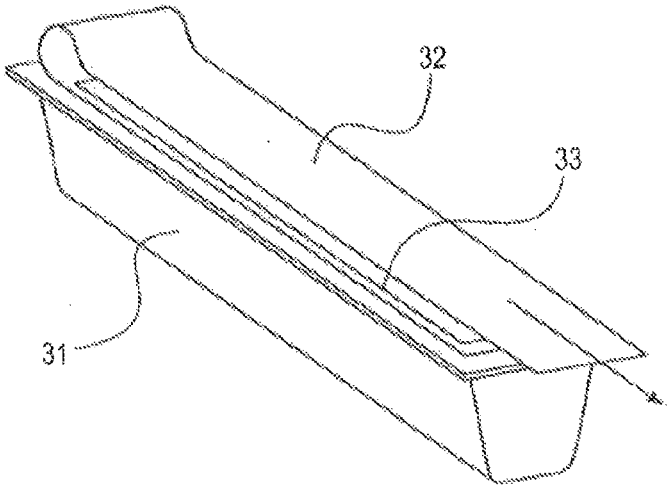
Fig. 14 PRIOR ART

FIG. 14 is a perspective view showing a state of a developer accommodating portion of a process cartridge for use with a conventional image forming apparatus.

DESCRIPTION OF THE PREFERRED EMBODIMENTS

With reference to the drawings, embodiments of the present invention will be described specifically below.

In the following description, a developer accommodating container at least includes a flexible container and a sealing member, provided to the flexible container, for sealing an opening for permitting discharge of a developer.

<Embodiment 1>

(Structure of Image Forming Apparatus)

Figure 1:
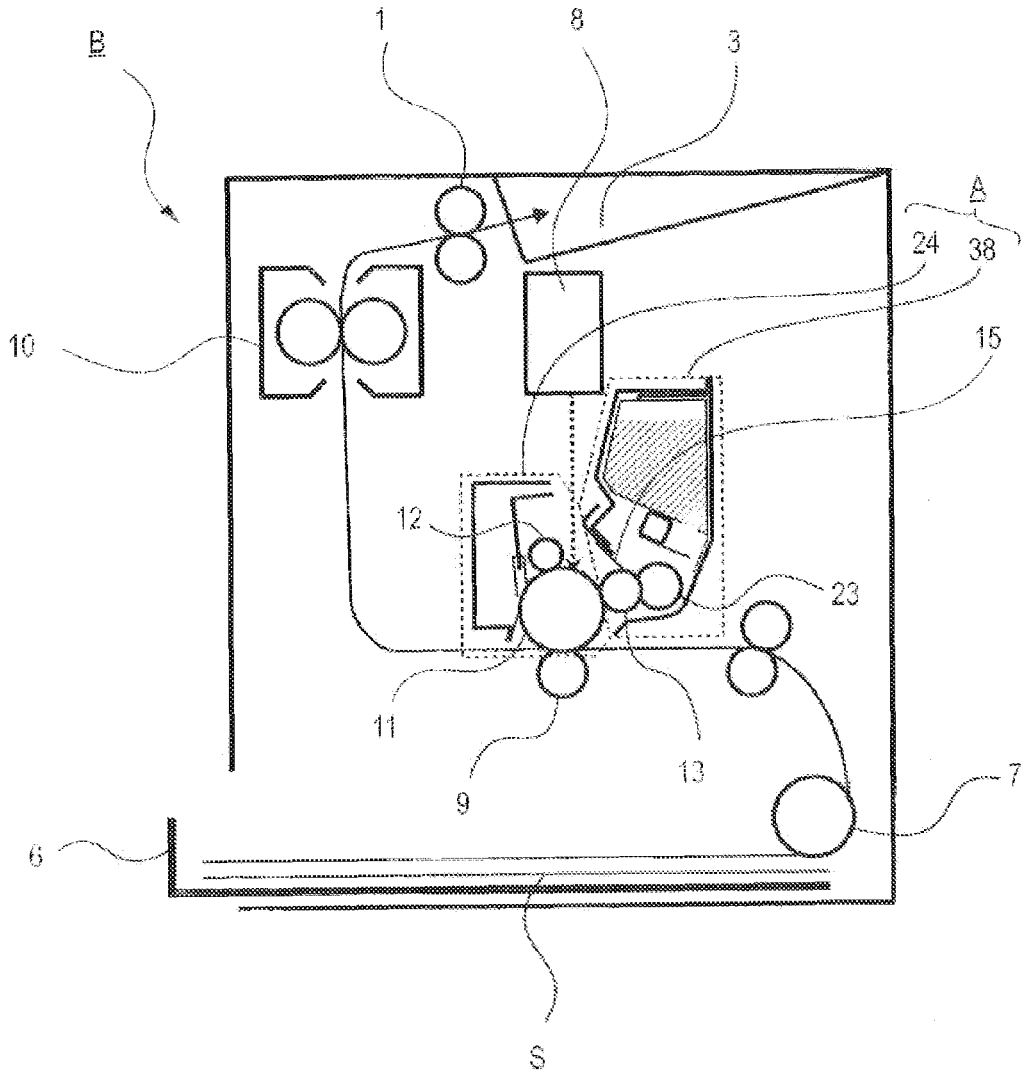
FIG. 1 is a sectional view showing a structure of an image forming apparatus in Embodiment 1 of the present invention.

FIG. 1 is a principal sectional view showing a structure of an image forming apparatus main assembly B in this embodiment.

In image formation, a sheet S (image forming material or medium) is fed by a feeding roller 7 from a sheet cassette 6 mounted at a lower portion of the image forming apparatus main assembly B, and in synchronism with the sheet feeding, a latent image is formed on a photosensitive drum 11 by effecting selective light exposure from an exposure device 8. A developer is supplied to a developing roller 13 (developer carrying member) by a sponge-like developer supplying roller 23, and is carried in a thin layer at a surface of the developing roller 13 by a developing blade 15.

By applying a developing bias to the developing roller 13, the developer is supplied depending on the latent image to develop the latent image into a desired developer image. This developer image is transferred onto the sheet S by bias voltage application to a transfer roller 9 (image transfer means). The sheet S is conveyed to a fixing device 10 and is then subjected to image fixing, and thereafter is discharged onto a discharge portion 3 at an upper portion of the image forming apparatus main assembly by a discharging roller 1.

Incidentally, a photosensitive drum 11 is provided, in a cleaning unit 24, and a developing roller 13, a developer supplying roller 23 and a developing blade 19 are provided in a developing (device) unit 38. Further, the cleaning unit 24 and the developing unit 38 constitute a process cartridge A.

(Structure of Process Cartridge)

The process cartridge includes an image bearing member and process means actable on the image bearing member. Here, as the process means, there are, e.g., a charging means for electrically charging a surface of the image bearing member, a developing device for forming an image on the image bearing member, and a cleaning means for removing a developer (containing a toner, a carrier and the like) remaining on a surface of the image bearing member.

Figure 2:
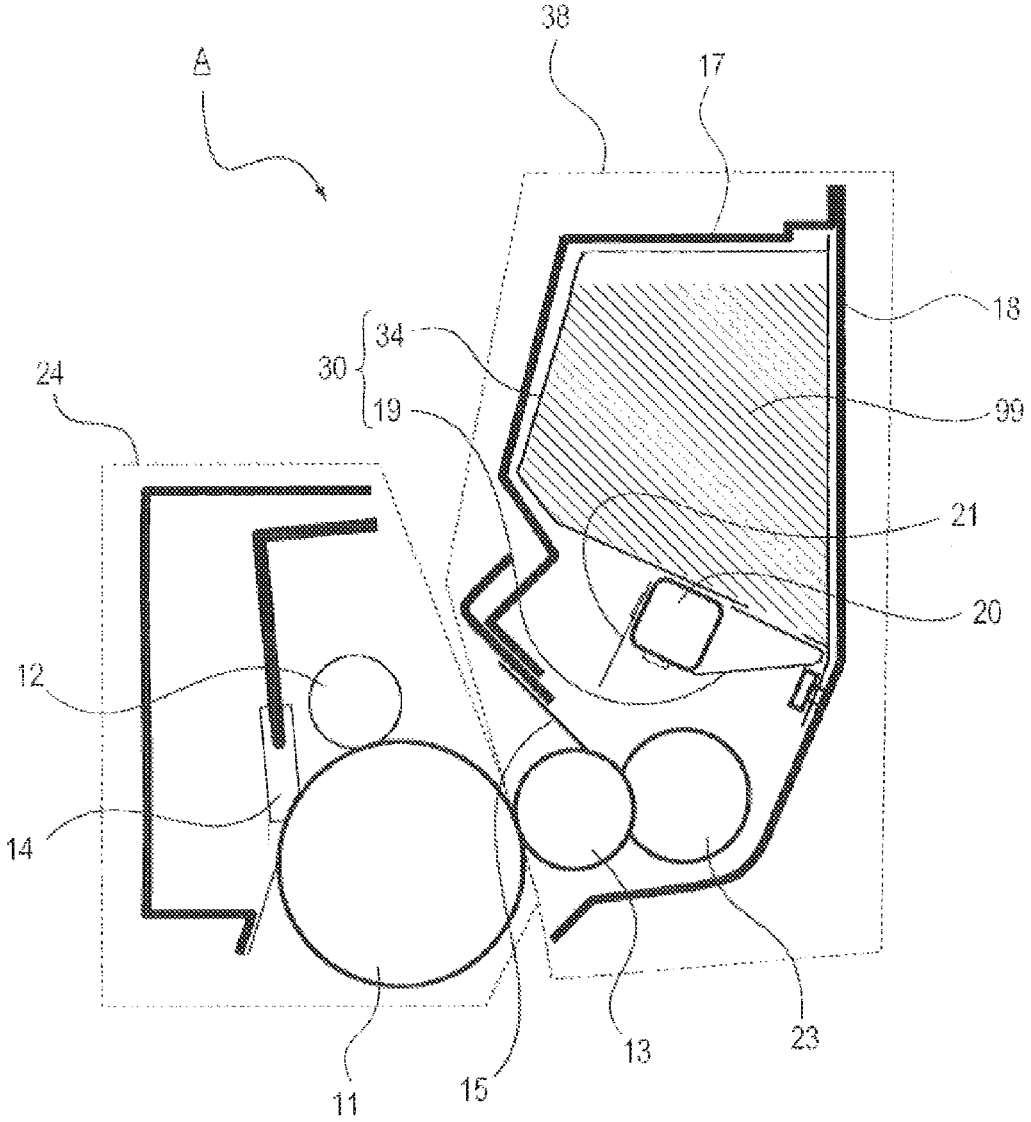
FIG. 2 is a sectional view showing a structure of a process cartridge to be mounted in the image forming apparatus as shown in FIG. 1.

FIG. 2 is a sectional view showing a structure of the process cartridge A to be mounted in the image forming apparatus main assembly B as shown in FIG. 1.

The process cartridge A in this embodiment includes, as shown in FIG. 2, includes the photosensitive drum 11 as the image bearing member and includes, at a periphery of the photosensitive drum 11, a charging roller 12 as the charring means and the cleaning unit 24 including an elastic cleaning blade 14. Further, the process cartridge A includes the developing unit 38 including the developing roller 13 and the developing blade 15 which constitute a developing means, the developer supplying roller 23, a developer accommodating container 30, a frame 17 and a frame 18. The process cartridge A is prepared by integrally assembling the cleaning unit 24 and the developing unit 38, and is constituted so as to be detachably mountable to the image forming apparatus main assembly B as shown in FIG. 1.

(Structure of Developing Unit)

Next, a structure of the developing unit 38 will be described.

Figure 3:
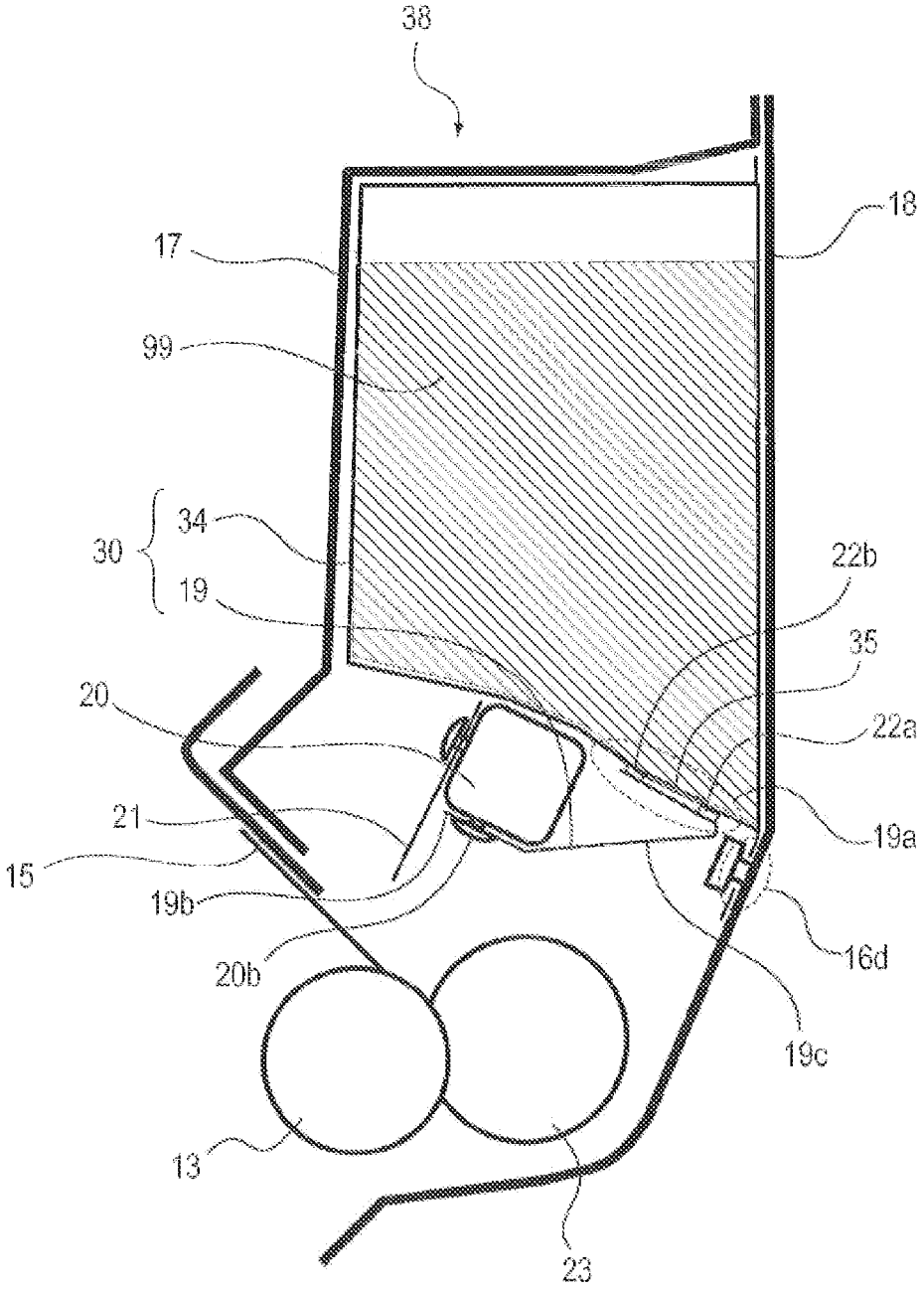
FIG. 3 is a sectional view of a developing unit before unsealing in Embodiment 1.

FIG. 3 is a sectional view of the developing unit 36 before unsealing.

As shown in FIG. 3, the developing unit 38 is constituted by the developer accommodating container 30, the developing roller 13, the developing blade 15, the developer supplying roller 23, and the frames 17 and 18 for supporting these members. The frames 17 and 18 constitute in combination a frame for accommodating the developer accommodating container 30.

Incidentally, in this embodiment, the developer accommodating container 30, the developing roller is and the developing blade 15 are provided in the frames 17 and 18, but the developer accommodating container 30 may also be provided in a frame which is a separate member from the frames 17 and 18. In this case, the developing unit 38 is constituted by a developer accommodating unit (not shown) in which the developer accommodating container 30 is provided, the developing roller 13, the developing blade 15 and the developer supplying roller 23. The developer accommodating unit includes at least the developer accommodating container 30 and a frame for accommodating the developer accommodating container 30.

(Structure of Developer Accommodating Container)

Figure 4:
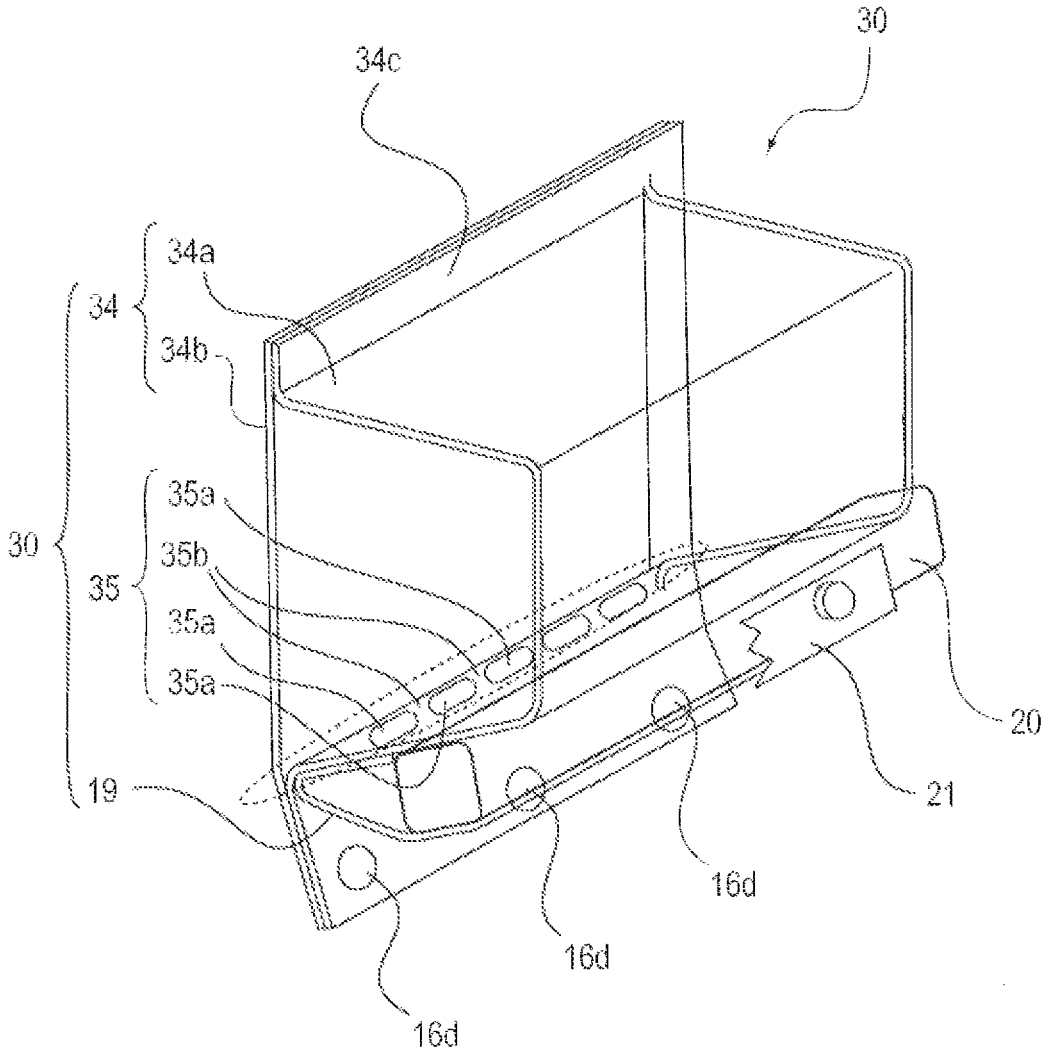
FIG. 4 is a perspective view of a developer accommodating container in Embodiment 1.

FIG. 4 is a perspective view of the developer accommodating container 30 to be incorporated into the developing unit 38.

As shown in FIG. 4, the developer accommodating container 30 is constituted by a developer accommodating member 34 and a sealing member 19 for sealing a plurality of openings 35*a* for permitting discharge of the developer and for exposing the openings 35*a* by being moved.

(Structure of Developer Accommodating Member)

As shown in FIG. 4, the developer accommodating member 34 is constituted by an accommodating portion 34*a* (first flexible member) as the flexible container having flexibility and a sheet portion 34*b* (second flexible member) having flexibility. The accommodating portion 34*a* has a three-dimensional shape formed three-dimensionally with respect to a direction in which the accommodating portion 34*a* is departed from the sheet portion 34*b*.

The accommodating portion 34*a* is formed by subjecting a sheet-like material to thermal molding, such as a vacuum molding, air-pressure molding, vacuum air-pressure molding, blow molding, injection molding, compression molding or transfer molding.

In the molding of the accommodating portion 34*a*, by using these molding methods, it is possible to subject the flexible material to high-speed processing, and in addition, it becomes possible to provide an in-line molding step in an assembling step (process).

As the material for the accommodating portion 34*a*, it is preferable that a single-layer material of ABS, PMMA, PC, PP, PE, HIPS, PET, NY, EVA, PVC or the like and a composite multi-layer material of these resins are used. Further, a thickness of five accommodating portion 34*a* may preferably be about 0.1-1 mm as a sheet-like thickness before the molding, but may only be appropriately selected depending on a cost, product specifications, a manufacturing condition and the like.

As shown in FIG. 4, the accommodating portion 34*a* is bonded to the sheet portion 34*b* at an outer peripheral portion 34*c* of the accommodating portion 34*a*, and a space for accommodating the developer is formed between the accommodating portion 34*a* and the sheet portion 34*b*. As a bonding method between the accommodating portion 34*a* and the sheet portion 34*b*, there are thermal welding, laser welding, ultrasonic welding, solvent welding, an adhesive, an adhesive tape, and the like.

As shown in FIG. 3, the developer accommodating member 34 accommodates a developer 99 therein. Further, as shown in FIG. 4, at a part of the outer peripheral portion 34*c*, a fixing portion 16*d* for fixing the developer accommodating member 34 is provided. As a means for fixing the fixing portion 16*d* it is possible to cite the thermal welding, the ultrasonic welding, adhesive bonding, clamping between the frames, thermal caulking, ultrasonic caulking, hooking using a hole and a projection, and the like, but in this embodiment, the hooking using the hole and the projection is employed.

A shape of the accommodating portion 34*a* is a shape along the inside wall of the frames 17 and 18.

By shaping the accommodating portion 34*a* by the molding method, the following effects are obtained.

That is, a gap is not formed between the developer accommodating member 34 and the frame 17, so that a developer accommodating space can be created effectively. Further, the developer accommodating member 34 can be formed in a shape which does not interfere with the frame 17 and therefore the developer accommodating member 34 can be easily incorporated into the frames. This is because there is no need to push the developer accommodating member 34 into the frames to adjust the shape during assembling.

Incidentally, the injection opening for permitting injection of the developer will be specifically described later.

(Structure of Sealing Member)

As shown in FIGS. 3 and 4, the sealing member 19 covers the opening 35 of the developer accommodating member 34 (between parts 22*a* and 22*b*) before use of the cartridge A to confine the developer in the developer accommodating member 34. The sealing member 19 is moved, so that the openings 35*a* (discharge openings) are exposed. The sealing member 19 is constituted by a sheet-like member including a sealing portion 19*a* for covering (sealing) the discharge portion 35 of the developer accommodating member 34, a portion-to-be-engaged 19*b* to be fixed (engaged) with the unsealing member 20, and a connecting portion 19*c* which connects the sealing portion 19*a* and the portion-to-be-engaged 19*b*. The sheet member is formed of a laminate material, described later, having a sealant layer which exhibits an easy-unsealing property, and a base material therefor is polyethylene telephthalate (PET), polyethylene, polypropylene or the like. A thickness of the sheet member may appropriately be set in a range of 0.03-0.15 mm.

The sealing portion 19*a* is a region where the sealing member 19 seals the plurality of openings 35*a* and connecting portions 35*b* of the developer accommodating member 34. By the sealing portion 19*a*, the developer 99 is prevented from being leaked from the inside of the developer accommodating member 34 until before use of the process cartridge A.

As shown in FIG. 3, on the unsealing member 20, the portion-to-be-engaged 19*b* of the sealing member 19 is fixed by a fixing portion 20*b*, and the sealing member 19 is wound up by rotation of the unsealing member 20, so that the sealing portion 19*a* is peeled off from the openings 35*a*.

Incidentally, on the unsealing member 20, an urging member 21 is fixed, and when the unsealing member 20 is rotated, the urging member 21 urges the developer accommodating member 34, so that the developer can be discharged efficiently.

(Injection of Developer)

Parts (a), (b) and (c) of FIG. 5 are perspective views showing states before and after the developer 99 is injected into the developer accommodating container 30. Part (a) of FIG. 5 is the perspective view showing the state before the injection opening is opened, (b) of FIG. 5 is the perspective view showing the state in which the injection opening is opened, and (c) of FIG. 5 is the perspective view snowing the state after the developer is injected.

As shown in (a) of FIG. 5, the developer accommodating container 30 is not filled, with the developer 99 and is provided with an injection opening 39 for permitting injection (filling) of the developer 99.

That is, the developer accommodating member 34 of the developer accommodating container 30 includes the injection opening 39 for permitting injection of the developer and the openings 35*a* for permitting discharge of the developer.

At first, the developer accommodating container 30 has not been yet filled with the developer.

Next, as shown in (b) of FIG. 5, the developer accommodating container 30 is filled with the developer from the injection opening 39 for permitting injection of the developer. Further, by the flexibility of the developer accommodating member 34, the injection opening 39 is deformable correspondingly to a filling devise to facilitate filling of the developer with no scattering of the developer. During the filling, a known auger type filling device is used, but another method having a similar function may also be used.

Next, as shown in (c) of FIG. 5, the injection opening 39 is bonded to form a bonding portion 39*a*, thus effecting the sealing. The bonding of the bonding portion 39*a* of the injection opening 39 for permitting injection of the developer is performed by the ultrasonic welding in this embodiment, but as other methods, there are the thermal welding, the laser welding, the solvent welding, the adhesive, the adhesive tape and the like.

Then, when the bonding of the bonding portion 39*a* of the injection opening 39 is completed, the filling of the developer is completed.

Incidentally, a position and a size of the injection opening 39 for permitting the filling of the developer are determined correspondingly to the filling device of the developer 99, the shape of the process cartridge A, and the like.

In this way, each or the openings 35*a* and the injection opening 39 of the developer accommodating container 30 is sealed and therefore the accommodated developer is not leaked out to the outside, so that the developer can be treated as a single unit. Further the sealing member 19 is provided with holes as the portion-to-be-engaged 19*b* to be engaged with the unsealing member 20, thus being engagable with the unsealing member 20.

(Sealing of Injection Opening)

FIG. 6 is a perspective view of the developer accommodating member 34 for illustrating the sealing of the injection opening.

In the state of (a) of FIG. 5, the outer peripheral portion 34*c* of the accommodating portion 34*a* and the sheet portion 34*b* are bonded by a bonding portion 34*k*. Then, the bonding portion 39*a* of the injection opening is bonding-processed to the bonding portion 31*k* between the outer peripheral portion 34*c* of the accommodating portion 34*a* and the sheet portion 34*b* after the developer accommodating member 34 is filled with the developer 99 and is placed in the state of (c) of FIG. 5. At this time, an overlapping portion 40 where the bonding portion 34*k* and the bonding portion 39*a* overlap with each other is formed, so that the leakage of the developer can be prevented with reliability.

(Insertion of Filling Nozzle)

Insertion of a filling nozzle will be described with reference to FIGS. 6 to 10.

Incidentally, an adjacent side 34*h* adjacent to the injection opening 39 in FIGS. 6, 7 and 9 is defined as a single side or a plurality of sides outside the accommodating portion 34*a* substantially adjacent to the injection opening 39 constituted by a portion where the outer peripheral portion 34*c* of the accommodating portion 34*a* and the sheet portion 34*b* are not bonded to each other.

The insertion of the tilling nozzle for filling the developer will be described with reference to FIGS. 7 and 8. Part (a) of FIG. 7 shows the developer accommodating member 84 before the filling, and (b) of FIG. 7 shows the developer accommodating member 34 in a state in which a filling nozzle 80 is inserted through the injection opening 39 during the filling.

Of sides constituting the developer accommodating member 34, the adjacent side 34*h* adjacent to the injection opening 39 has an angle θ0 of 90 degrees with respect to a developer injection dissection at the injection opening 39 ((a) of FIG. 7), so that the adjacent side 34*h* corresponding to a position of the injection opening 39 is largely displaced by the insertion of the filling nozzle 80 ((b) of FIG. 7).

Parts (a) and (b) of FIG. 8 are sectional views of the developer accommodating member 34 along a cross section passing through the center of the injection opening of the developer accommodating member 34 shown in (a) and (b) of FIG. 7, respectively. In order to prevent the scattering (diffusion) of the developer by eliminating the gap between the developer accommodating member 34 and the filling nozzle 80 during the developer filling, an injection opening holding jig 70 consisting of injection opening holding portions 70*a* and 70*b* is needed, but as shown in (b) of FIG. 8, the adjacent side 34*h* is displaced upward in the figure so as to be largely waved by the insertion of the filling nozzle 80 and contacts the injection opening holding portion 70*a* at an interference portion 71, so that there is the case where it is difficult to ensure reliability of a developer filling step. Further, also in a filling step in which the injection opening holding jig 70 is not used, a magnitude and instability of the displacement of the adjacent side 34*h* becomes problematic in manufacturing in some cases such that a volume fluctuation is generated every time since predictability of a behavior of the developer accommodating member 34 is impaired.

(Inclined Structure of Adjacent Side)

Next, the developer accommodating member 34 having an inclined structure in the adjacent side 34*h* will be described with reference to FIGS. 9 and 10, Part (a) of FIG. 9 shows the developer accommodating member 34 before filling, and (b) of FIG. 9 shows the developer accommodating member 34 in a state in which the filling nozzle 80 is inserted through the injection opening 39 during the filling.

Of sides constituting the developer accommodating member 34, the adjacent side 34*h* adjacent to the injection opening 39 has an angle of less than 90 degrees with respect to a developer injection direction at the injection opening 39 ((a) of FIG. 9), so that the displacement of the adjacent side 34*h* adjacent to the injection opening 39 by the insertion of the filling nozzle 80 can be controlled so that the adjacent side 34*h* is always located downward in the figure when compared with the conventional case of 90 degrees in angle with respect to the developer injection direction ((b) of FIG. 9).

Parts (a) and (b) of FIG. 10 are sectional views of the developer accommodating member 34 along a cross section passing through the center of the injection opening of the developer accommodating member 34 shown in (a) and (b) of FIG. 9, respectively. In the case where the developer accommodating member 34 is held by an injection opening holding jig 70, consisting of injection opening holding portions 70*a* and 70*b*, for preventing the scattering (diffusion) of the developer by eliminating the gap between the developer accommodating member 34 and the filling nozzle 80 during the developer filling, as shown, in (b) of FIG. 10, the displacement of the adjacent side 34*h* generated by the insertion of the filling nozzle 80 can be always controlled so as to be directed downward, the injection opening holding portion 70*a* at an interference, so that it is possible to ensure reliability of a developer filling step without causing the adjacent side 34*h* to contact the injection opening holding portion 70*a*.

A principal reason therefor is as follows,

When the injection opening 39 is changed from a plane to a three-dimensional shape, in the case where the adjacent side 34*h* which is the plane is changed in shape along the plane, the adjacent side 34*h* cannot maintain its plane and is inclined in a direction in which the whole adjacent side 34*h* approaches the injection opening 39. in the case where as shown in (a) of FIG. 10, the adjacent side 34*h* is inclined downward in the figure from a normal to the injection opening 39 in an initial state, the displacement generated by the insertion of the filling nozzle 80 always advances, as shown in (b) of FIG. 10, downward in the figure without resisting the inclination.

Although the shaping of the accommodating portion 34*a*, which is the flexible container of the developer accommodating member 34, by subjecting the sheet-like material to the vacuum molding, the air-pressure molding, the vacuum air-pressure molding, the press molding or the blow molding is described above, it can be assumed that as a draft (tapered angle) of the molding in the molding method, 0 to 2 degrees can be used.

Accordingly, when the draft is taken into consideration, in order to substantially obtain the effect of the present invention, it is preferable that the side is inclined of an angle exceeding the draft of the molding, and therefore it can be said that the case where the adjacent side has an angle θ of less than 88 degrees fails under the concept of the present invention.

<Embodiment 2>

Another embodiment of the present, invention will be described with reference to FIG. 11.

Part (a) of FIG. 11 shows an example in which of sides constituting the developer accommodating member 34, an adjacent side 34*h* adjacent to the injection opening 39 has an angle of less than 90 degrees with respect to the developer injection direction at the injection opening 39 and is inclined also with respect to the outer peripheral portion 34*c* of the accommodating portion 34*a*.

Part (b) of FIG. 11 shows the case where adjacent sides 34*h* are formed by a plurality of sides each having the angle of less than 90 degrees with respect to the injection opening 39.

Part (c) of FIG. 11 shows an example in which a side in accordance with the definition of the adjacent side is an adjacent side 34*h* in the figure, and other than the adjacent side 34*h*, a plurality of sides 34*m* and 34*n* are provided. The adjacent side 34*h* is narrowed in width with a distance from the injection opening 39.

In either case, similarly as in Embodiment 1, when the injection opening 39 is deformed, it is possible to control a direction of deformation of the adjacent side 34*h* so that the adjacent side 34*h* is deformed downward in the figures.

<Embodiment 3>

Another embodiment of the present invention will be described with reference to FIGS. 12 and 13.

Part (a) of FIG. 12 shows an example in which of sides constituting the developer accommodating member 34, an close side 37*h* close to the injection opening 39 has an angle of less than 90 degrees with respect to the developer injection direction at the injection opening 39. An adjacent side 36 adjacent to the injection opening 39 does not have the angle of less than 90 degrees with respect to the injection direction at the injection opening 39.

In this embodiment, the close side 37*h* is defined as "a side (except for the adjacent side 36), of sides constituting the developer accommodating member 34, opposing the injection opening holding portion 70*a* during the developer filling".

Part (b) of FIG. 12 shows an example in which a side in accordance with the definition or the close side is a close side 37*h* in the figure, and other than the close side 37*h*, a plurality of sides 37*m* and 37*n* are provided. The close side 37*h* is narrowed in width with a distance from the injection opening 39.

Parts (a) and (b) of FIG. 13 are sectional views each showing a cross section passing through the center of the injection opening of the developer accommodating member 34. In the case where the developer accommodating member 34 is held by the injection opening holding jig 70, consisting of the injection opening holding portions 70*a* and 70*b*, for preventing the scattering (diffusion) of the developer by eliminating the gap between the developer accommodating member 34 and the filling nozzle 80 during the developer filling, as shown in (b) of FIG. 13, by the insertion, of the filling nozzle 80, the displacement of the close side 37*h* in accordance with the definition of the close side can be always controlled so as to be directed downward but the adjacent side 36 which is not in accordance with the definition (of the close side) cannot be controlled so as to be directed downward. However, within a range in which the displacement is allowed, each of the adjacent side 36 and the close side 37*h* does not contact the injection opening holding portion 70*a*, so that it is possible to ensure reliability of the developer filling step.

Similarly as in Embodiment 1, when the injection opening 33 is deformed, it is possible to control a direction of deformation of the close side 37*h* so that the close side 37*h* is deformed downward in the figures.

The present invention is applicable to an image forming apparatus such as a printer.

According to the present invention, an outside adjacent side of the three-dimensional shape adjacent to the injection opening is provided so as to be inclined to have the angle of less than 90 degrees with respect to the developer injection direction. For this reason, even in the case where the holding jig or the like is used at the injection opening, the holding jig (device) and the developer accommodating container do not interfere with each other and thus it is possible to perform the filling step with reliability.

While the invention has been described with reference to the structures disclosed herein, it is not confined to the details set forth and this application is intended to cover such modifications or changes as may come within the purpose of the improvements or the scope of the following claims.

This application claims priority from Japan Parent Application No. 199352/2012 filed Sep. 11, 2012, which is hereby incorporated by reference.

What is claimed is:

1. A developer accommodating container for accommodating a developer for image formation, said developer accommodation container comprising:

a first flexible member having an inclined shape; and a second flexible member, wherein said developer accommodating container is constituted by bonding said first flexible member and said second flexible member to each other, wherein said developer accommodating container has an injection opening for permitting injection of the developer, wherein said inclined shape is adjacent to side injection opening and has an angle of less than 90 degrees with respect to an injection direction of the developer at said injection opening and with respect to a plane perpendicular to the injection direction, wherein said inclined shape is deformed to permit injection of the developer when the developer is injected into said developer accommodating container, and wherein said inclined shape is formed by molding.

2. A developer accommodating container according to claim 1, wherein, after the developer is injected through said injection opening, said injection opening is sealed by bonding.

3. A developer accommodating container according to claim 2, further comprising a plurality of discharge openings for permitting the developer to be discharged from said developer accommodating container and for using the developer accommodated in said developer accommodating container for the image formation.

4. A process cartridge detachably mountable to a main assembly of an image forming apparatus, said process cartridge comprising:

a developer accommodating container according to claim 2; and a developer carrying member for carrying the developer discharged from a discharge opening of said developer accommodating container.

5. An image forming apparatus comprising:

a process cartridge according to claim 4; and transfer means for transferring an image, formed by development by said process cartridge, on an image forming material.

6. A developer accommodating container according to claim 2, wherein a plurality of discharge openings is aligned along the injection direction.

7. A developer accommodating container according to claim 1, wherein a side including said inclined shape has an angle of less than 88 degrees with respect to the injection direction at said injection opening.

8. A developer accommodating container according to claim 1, wherein said inclined shape is formed by using thermal molding.

9. A developer accommodating container according to claim 8, wherein the thermal molding is any one of vacuum molding, air-pressure molding, blow molding, injection molding, compression molding and transfer molding.

10. A developer accommodating container according to claim 1, wherein said first flexible member and said second flexible member are bonded by using any one of thermal welding, laser welding, ultrasonic welding, solvent welding, an adhesive and an adhesive tape.

11. A developer accommodating container according to claim 1, further comprising a plurality of discharge openings for permitting the developer to be discharged from said developer accommodating container and for using the developer accommodated in said developer accommodating container for the image formation.

12. A developer accommodating container according to claim 11, wherein the plurality of discharge openings is aligned along the injection direction.

13. A developer accommodating container for accommodating a developer for image formation, said developer accommodating container comprising:

a first flexible member having an inclined shape; and a second flexible member, wherein said developer accommodating container is constituted by bonding said first flexible member and said second flexible member to each other, wherein said developer accommodating container has an injection opening for permitting injection of the developer, and said developer accommodating container has a plurality of discharge openings for permitting the developer to be discharged from said developer accommodating container, wherein said inclined shape is adjacent to said injection opening and has an angle of less than 90 degrees with respect to an injection direction of the developer at said injection opening and with respect to a plane perpendicular to the injection direction, and wherein said inclined shape is deformed to permit injection of the developer when the developer is injected into said developer accommodating container.

* * * * *